US008629816B2

(12) United States Patent
Chung

(10) Patent No.: US 8,629,816 B2
(45) Date of Patent: Jan. 14, 2014

(54) EMISSION CONTROL DRIVER AND ORGANIC LIGHT EMITTING DISPLAY USING THE SAME

(75) Inventor: Kyung-Hoon Chung, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 540 days.

(21) Appl. No.: 12/805,704

(22) Filed: Aug. 16, 2010

(65) Prior Publication Data

US 2011/0057864 A1 Mar. 10, 2011

(30) Foreign Application Priority Data

Sep. 8, 2009 (KR) ..... 10-2009-0084411

(51) Int. Cl.
*G09G 3/30* (2006.01)

(52) U.S. Cl.
USPC ..... 345/76; 345/211; 345/100; 345/46; 345/109; 345/94

(58) Field of Classification Search
None
See application file for complete search history.

(56) References Cited

U.S. PATENT DOCUMENTS

2004/0263440 A1* 12/2004 Kimura et al. ..... 345/76
2006/0156121 A1 7/2006 Chung
2007/0079191 A1* 4/2007 Shin ..... 714/726
2007/0296681 A1* 12/2007 Kim et al. ..... 345/100
2008/0048946 A1* 2/2008 Kwak ..... 345/76
2008/0055207 A1 3/2008 Chung
2008/0157684 A1* 7/2008 Chung ..... 315/169.3
2008/0266477 A1* 10/2008 Lee et al. ..... 349/46

FOREIGN PATENT DOCUMENTS

JP 2007-127918 A 5/2007
KR 10-2006-0081582 A 7/2006
KR 10 2008-0011944 A 2/2008
KR 10 2008-0020352 A 3/2008
KR 10-2008-0020354 A 3/2008
KR 10 2008-0062458 A 7/2008

* cited by examiner

*Primary Examiner* — Kent Chang
*Assistant Examiner* — Benjamin Morales Fernandez
(74) *Attorney, Agent, or Firm* — Lee & Morse, P.C.

(57) ABSTRACT

An emission control driver including a plurality of stages, each including a first unit adapted to generate a first output signal at a first node thereof based on an input signal, a clock signal, a inverted input signal, first and second power source voltages, a second unit adapted to output an emission control signal based on the first output signal and the input signal, a third unit adapted to transmit the first or second power source to the first unit based on the emission control signal, a inverted clock signal and an inverted emission control signal when a first path between the first power source and the first node and a second path between the second power source and the first node are blocked by the clock signal, and a fourth unit adapted to output a inverted emission control signal based on the emission control signal and the first output signal.

23 Claims, 7 Drawing Sheets

EMISSION CONTROL DRIVER AND ORGANIC LIGHT EMITTING DISPLAY USING THE SAME

BACKGROUND

1. Field

Embodiments relate to an emission control driver and an organic light emitting display using the same. More particularly, embodiments relate to an emission control driver adapted to control pulse width of emission control signals and a number of pulses, and an organic light emitting display using the same.

2. Description of the Related Art

In a flat panel display (FPD), a plurality of pixels may be arranged on a substrate. The pixels may be arranged in a matrix pattern and may define a display region. Scan lines and data lines may be coupled to pixels so that data signals may be selectively applied to the pixels to display an image.

A FPD may be a passive matrix type light emitting display or an active matrix type light emitting display based on a method of driving the respective pixels thereof. Active matrix type FPDs are generally advantageous with regard to resolution, contrast, and operation speed, and may be more commonly used to selectively illuminate the pixels of a display.

FPDs may be used as displays of portable information terminals such as personal computers, mobile telephones, and personal digital assistants (PDAs) or monitors of various information apparatus. A liquid crystal display (LCD) using a liquid crystal panel, an organic light emitting display using an organic light emitting diode (OLED), and a plasma display panel (PDP) using a plasma panel are known as the FPDs.

Recently, various light emitting displays that are lighter in weight and smaller in volume as compared to cathode ray tubes (CRTs) have been developed. In general, organic light emitting displays provide advantages such as relatively high emission efficiency and brightness, a relatively large viewing angle, and relatively fast response speed.

While many advances have been made, improved organic light emitting displays and/or improved drivers for such organic light emitting displays are desired. For example, improved organic light emitting displays that consume relatively less power and/or may be adapted to, e.g., better control a pulse width and/or a number of pulses of emission control signals are desired.

SUMMARY

Embodiments are therefore directed to emission control drivers and organic light emitting displays, which substantially overcome one or more of the problems due to the limitations and disadvantages of the related art.

It is therefore a feature of an embodiment to provide an emission control driver capable of simply controlling a pulse width and a number of pulses of emission control signals.

It is therefore a separate feature of an embodiment to provide an organic light emitting display employing an emission control driver capable of simply controlling a pulse width and a number of pulses of emission control signals.

It is therefore a separate feature of an embodiment to provide an emission control driver adapted to control a pulse width and a number of pulses of emission control signals, and an organic light emitting display including such an emission control driver such that when current does not flow through an OLED of pixels being driven by the emission control signals, it corresponds to an input of a black signal so that a latent image can be reduced.

At least one of the above and other features and advantages may be realized by providing an emission control driver including a plurality of stages adapted to receive voltages from a first power source and a second power source and to generate emission control signals, wherein each of the stages includes a first signal processing unit adapted to generate a first output signal based on an input signal, a clock signal, a inverted input signal, the first power source, and the second power source, the first output signal being supplied at a first node of the first signal processing unit, a second signal processing unit adapted to output an emission control signal based on the first output signal and the input signal, the emission control signal corresponding to an inverse of the first output signal, a third signal processing unit adapted to transmit a voltage of the first power source or the second power source to the first signal processing unit based on the emission control signal, a inverted clock signal, and an inverted emission control signal when a first path, between the first power source and the first node, and a second path, between the second power source and the first node, are blocked by the clock signal, the inverted emission control signal corresponding to an inverse of the emission control signal, and a fourth signal processing unit adapted to output a inverted emission control signal based on the emission control signal and the first output signal.

The first signal processing unit may include first, second, third, and fourth transistors, wherein a source of the first transistor may be coupled to the first power source, a drain of the first transistor may be coupled to a source of the second transistor, and a gate of the first transistor may be coupled to an input signal terminal to which the input signal is input, wherein a drain of the second transistor may coupled to the first node, and a gate of the second transistor may be coupled to a clock terminal to which the clock signal is input, wherein a source of the third transistor may be coupled to the first node, a drain of the third transistor may be coupled to a source of the fourth transistor, and a gate of the third transistor may be coupled to the clock terminal, and wherein a drain of the fourth transistor may be coupled to the second power source, and a gate of the fourth transistor may be coupled to a inverted input signal terminal to which the inverted input signal is input.

The second signal processing unit may include fifth, sixth, seventh, and eighth transistors and a first capacitor, wherein a source of the fifth transistor may be coupled to the first power source, a drain of the fifth transistor may be coupled to a second node, and a gate of the fifth transistor may be coupled to the first node, a source of the sixth transistor may be coupled to the second node, a drain of the sixth transistor may be coupled to the second power source, and a gate of the sixth transistor may be coupled to an input signal terminal to which the input signal is transmitted, wherein a source of the seventh transistor may be coupled to the first power source, a drain of the seventh transistor may be coupled to an output terminal from which the emission control signal is output by inverting the first output signal, and a gate of the seventh transistor may be coupled to the first node, a source of the eighth transistor may be coupled to the output terminal, a drain of the eighth transistor may be coupled to the second power source, and a gate of the eighth transistor may be coupled to the second node, and wherein a first electrode of the first capacitor may be coupled to the second node and a second electrode of the first capacitor may be coupled to the output terminal.

The second signal processing unit may further include a seventeenth transistor, wherein a source of the seventeenth transistor is coupled to the second node, a drain of the seventeenth transistor is coupled to the source of the sixth transistor, and a gate of the seventeenth transistor is coupled to the clock terminal.

The third signal processing unit may include ninth, tenth, eleventh, and twelfth transistors, wherein a source of the ninth transistor may be coupled to the first power source, a drain of the ninth transistor may be coupled to a source of the tenth transistor, and a gate of the ninth transistor may be coupled to an output terminal from which the emission control signal is output, wherein a drain of the tenth transistor is coupled to a source of the eleventh transistor, and a gate of the tenth transistor is coupled to a inverted clock terminal from which the inverted clock signal is output, wherein a drain of the eleventh transistor may be coupled to a source of the twelfth transistor, and a gate of the eleventh transistor may be coupled to the inverted clock terminal, and wherein a drain of the twelfth transistor may be coupled to the second power source, and a gate of the twelfth transistor may be adapted to receive the first output signal.

The third signal processing unit may include ninth, tenth, eleventh, and twelfth transistors, wherein a source of the ninth transistor may be coupled to the first power source, a drain of the ninth transistor may be coupled to a source of the tenth transistor, and a gate of the ninth transistor may be coupled to an output terminal from which the emission control signal is output, wherein a drain of the tenth transistor may be coupled to a source of the eleventh transistor, and a gate of the tenth transistor may be coupled to a inverted clock terminal from which the inverted clock signal is output, wherein a drain of the eleventh transistor may be coupled to a source of the twelfth transistor, and a gate of the eleventh transistor may be coupled to the inverted clock terminal, and wherein a drain of the twelfth transistor may be coupled to the second power source, and a gate of the twelfth transistor is adapted to receive the inverted emission control signal.

A ratio of width/length of a channel region of the fifth transistor may be larger than a ratio of width/length of a channel region of the sixth transistor.

The third signal processing unit may include ninth, tenth, eleventh, and twelfth transistors, wherein a source of the ninth transistor may be coupled to the first power source, a drain of the ninth transistor is coupled to a source of the tenth transistor, and a gate of the ninth transistor may be coupled to an output terminal from which the emission control signal is output, wherein a drain of the tenth transistor may be coupled to a source of the eleventh transistor, and a gate of the tenth transistor may be coupled to a inverted clock terminal from which the inverted clock signal is output, wherein a drain of the eleventh transistor may be coupled to a source of the twelfth transistor, and a gate of the eleventh transistor may be coupled to the inverted clock terminal, and wherein a drain of the twelfth transistor may be coupled to the second power source, and a gate of the twelfth transistor may be adapted to receive the inverted emission control signal.

The third signal processing unit may include ninth, tenth, eleventh, and twelfth transistors, wherein a source of the ninth transistor may be coupled to the first power source, a drain of the ninth transistor may be coupled to a source of the tenth transistor, and a gate of the ninth transistor may be coupled to an output terminal from which the emission control signal is output, wherein a drain of the tenth transistor may be coupled to a source of the eleventh transistor, and a gate of the tenth transistor may be coupled to a inverted clock terminal from which the inverted clock signal is output, wherein a drain of the eleventh transistor may be coupled to a source of the twelfth transistor, and a gate of the eleventh transistor may be coupled to the inverted clock terminal, and wherein a drain of the twelfth transistor may be coupled to the second power source, and a gate of the twelfth transistor is adapted to receive the first output signal.

The fourth signal processing unit may include thirteenth, fourteenth, fifteenth, and sixteenth transistors, and a second capacitor, wherein a source of the thirteenth transistor may be coupled to the first power source, a drain of the thirteenth transistor is coupled to a third node, and a gate of the thirteenth transistor is coupled to an output terminal from which the emission control signal is output, wherein a source of the fourteenth transistor may be coupled to the third node, a drain of the fourteenth transistor is coupled to the second power source, and a gate of the fourteenth transistor may be adapted to receive the first output signal, wherein a source of the fifteenth transistor may be coupled to the first power source, a drain of the fifteenth transistor is coupled to a inverted output terminal from which the inverted emission control signal is output, and a gate of the fifteenth transistor may be coupled to the output terminal, wherein a source of the sixteenth transistor may be coupled to the inverted output terminal, a drain of the sixteenth transistor may be coupled to the second power source, and a gate of the sixteenth transistor may be coupled to the third node, and wherein the second capacitor may be coupled between the third node and the inverted output terminal.

The plurality of stages may include n stages, and for each of the second through n-th stages, the emission control signal output by the n-1th stage may be input as the input signal for the respective stage, and the inverted emission control signal output by the n-1th stage may be input as the inverted input signal for the respective stage.

A pulse width of the emission control signal may correspond to a same number of clock cycles as a pulse width of the input signal.

At least one of the above and other features and advantages may be separately realized by providing an organic light emitting display, including a pixel unit including a plurality of pixels arranged in a region defined by scan lines, emission control lines, and data lines, a scan driver adapted to transmit scan signals to the scan lines, an emission control driver adapted to transmit emission control signals to the emission control lines, a data driver adapted to transmit data signals to the data lines, and a controller adapted to generate control signals for controlling the scan driver, the emission control driver, and the data driver, wherein each of the stages, includes a first signal processing unit adapted to generate a first output signal based on an input signal, a clock signal, a inverted input signal, the first power source, and the second power source, the first output signal being supplied at a first node of the first signal processing unit, a second signal processing unit adapted to output the corresponding emission control signal based on the first output signal and the input signal, the emission control signal corresponding to an inverse of the first output signal, a third signal processing unit adapted to selectively transmit the first power source or the second power source to the first signal processing unit based on the emission control signal, a inverted clock signal, and an inverted emission control signal when a first path, between the first power source and the first node, and a second path, between the second power source and the first node, are blocked by the clock signal, the inverted emission control signal corresponding to an inverse of the emission control signal, and a fourth signal processing unit adapted to output a inverted emission control signal based on the corresponding emission control signal and the first output signal.

Each of the emission control signals may be transmitted to two of the emission control lines.

Each of the emission control signals may be transmitted to one of the emission control lines.

The controller may be adapted generate the input signal, the inverted input signal, the clock signal, and the inverted clock signal to control pulse widths of the input signal and the inverted input signal.

The pulse width of the input signal may correspond to a same number of clock periods as a pulse width of the corresponding emission control signal.

At least one of the above and other features and advantages may be separately realized by providing an emission control driver including a plurality of stages receiving a first power source and a second power source and driving the first power source and the second power source to generate emission control signals, wherein each of the stages includes a first signal processing unit adapted to generate a first output signal based on an input signal, a clock signal, a inverted input signal, the first power source, and the second power source, the first output signal being supplied at a first node of the first signal processing unit, a second signal processing unit adapted to output an emission control signal based on the first output signal and the input signal, the emission control signal corresponding to an inverse of the first output signal, a third signal processing unit adapted to selectively control a voltage at the first node of the first signal processing unit to correspond to a voltage transmitted from the first power source or the second power source, the third signal processing unit selectively controlling the voltage at the first node based on the emission control signal, a inverted clock signal, and an inverted emission control signal, the inverted emission control signal corresponding to an inverse of the emission control signal, and a fourth signal processing unit adapted to output a inverted emission control signal based on the emission control signal and the first output signal.

The first signal processing unit may include a plurality of transistors adapted to transmit the a voltage of the first power source or a voltage of the second power source to the first node based on the input signal, the clock signal and the inverted input signal, and the third signal processing unit is adapted to selectively control the voltage at the first node when the input signal, the inverted input signal and/or the clock signal prevent the transmission of the voltage of the first power source of the voltage of the second power source to the first node.

The first output signal may correspond to the inverted emission control signal, and the inverted emission control signal may be an inverse of the emission control signal.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION

Figure 1:
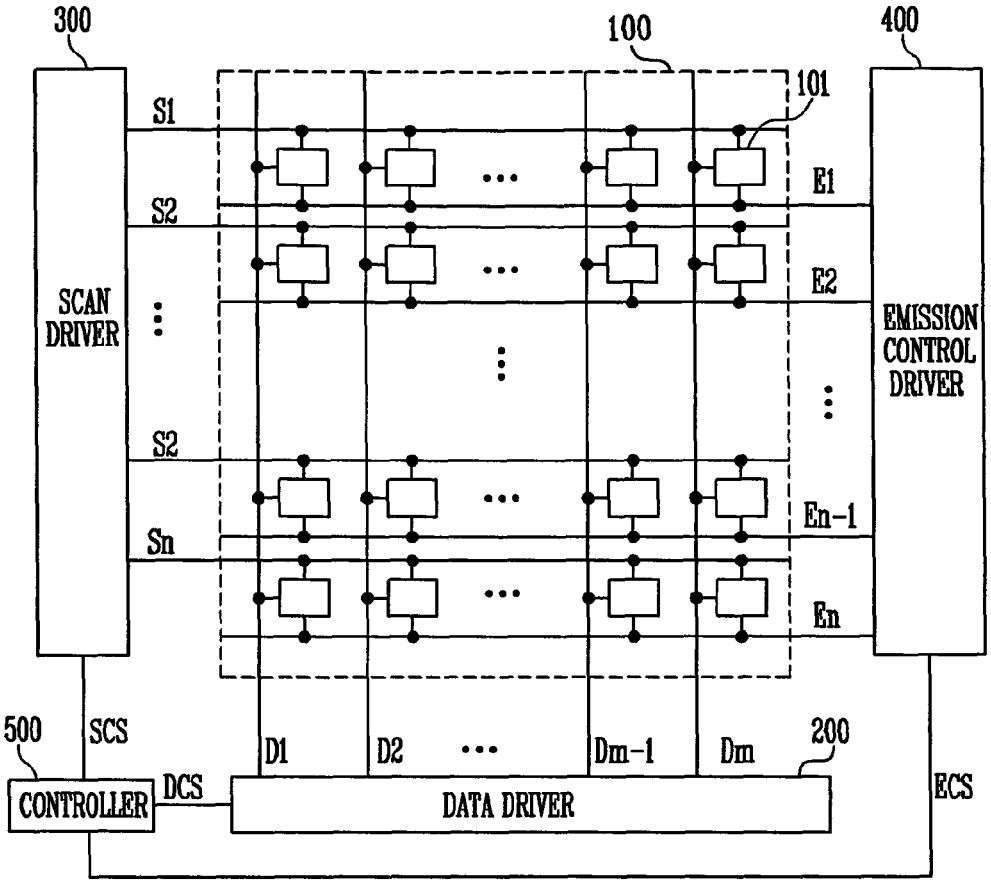
FIG. 1 illustrates a block diagram of a first exemplary embodiment of an organic light emitting display.

Korean Patent Application No. 10-2009-0084411, filed on Sep. 8, 2009, in the Korean Intellectual Property Office, and entitled: "Emission Driver and Organic Light Emitting Display Device Using the Same" is incorporated by reference herein in its entirety.

Exemplary embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "between" two elements, it may be the only element between the two elements, or one or more intervening elements may also be present. It will also be understood that when a first element is described as being coupled to a second element, the first element may not only be directly coupled to the second element but may also be indirectly coupled to the second element via one or more other elements. Further, some of the elements that are not essential to the complete understanding of the invention are omitted for clarity. Like reference numerals refer to like elements throughout the specification.

FIG. 1 illustrates a block diagram of a first exemplary embodiment of an organic light emitting display. Referring to FIG. 1, the organic light emitting display may include a pixel unit 100, a data driver 200, a scan driver 300, an emission control driver 400, and a controller 500.

The pixel unit 100 may include m data lines D1, D2, . . . , Dm−1, and Dm, n scan lines S1, S2, . . . , Sn−1, and Sn, and n emission control lines E1, E2, En−1, and En, and a plurality of pixels 101. The pixels 101 may be formed in a region defined by the m data lines D1, D2, . . . , Dm−1, and Dm, the n scan lines S1, S2, . . . , Sn−1, and Sn, and the n emission control lines E1, E2, En−1, and En. It should be understood that, although not shown, each of the pixels 101 may include a pixel circuit and an organic light emitting diode (OLED). For each of the pixels 101, the pixel circuit thereof may generate a pixel current that flows through the pixel based on data signals transmitted through the plurality of data lines D1, D2, . . . , Dm−1, and Dm and scan signals transmitted through the plurality of scan lines S1, S2, . . . , Sn−1, and Sn, and may control the pixel current flowing to the OLED based on emission control signals transmitted through the n emission control lines E1, E2, . . . , En−1, and En.

The data driver 200 may be coupled to the m data lines D1, D2, . . . , Dm−1, and Dm. The data driver 200 may generate the data signals to sequentially transmit the data signals for each column to the m data lines D1, D2, . . . , Dm−1, and Dm, respectively.

The scan driver 300 may be coupled to the n scan lines S1, S2, . . . , Sn−1, and Sn. The scan driver 300 may generate the scan signals to transmit the respective scan signals to the n scan lines S1, S2, . . . , Sn−1, and Sn. The scan signals may select a respective row of the pixels 101, and the data driver 200 may supply respective data signals to the pixels 101 positioned along the selected row. As a result, current corresponding to the data signals may be generated by the pixels, respectively.

The emission control driver 400 may be coupled to the n emission control lines E1, E2, . . . , En−1, and En. The emission control driver 400 may generate the emission control signals and may transmit the emission control signals to the n emission control lines E1, E2, . . . , En−1, and En, respectively. The emission control driver 400 may control a pulse width and a number of pulses of the emission control signals, respectively. The pixels 101 coupled to the emission control lines E1, E2, . . . , En−1, and En may receive the respective emission control signals. When a respective one of the emission control signals is supplied to a respective one of the n emission control lines E1 to En, current generated by each of the pixels 101 coupled to the respective emission control line E1 to En may flow to the corresponding OLEDs, respectively. A time period when the current generated by the respective pixel 101 may flow to the OLED thereof may be based on the respective emission control signal.

The controller 500 may transmit data driving control signals DCS to the data driver 200, may transmit scan driving control signals SCS to the scan driver 300, and may transmit emission control driving signals ECS to the emission control driver 400 for driving the data driver 200, the scan driver 300, and the emission control driver 400, respectively.

By controlling characteristics of the emission control driving signals ECS, the controller 500 may control a pulse width and a number of pulses of the emission control signals output from the emission control driver 400. More particularly, in embodiments, the controller 500 may control a pulse width and/or a number of pulses of a start pulse associated with the emission control driving signals ECS supplied to the emission control driver 400 such that a pulse width and a number of pulses of the emission control signals may be controlled.

Figure 2:
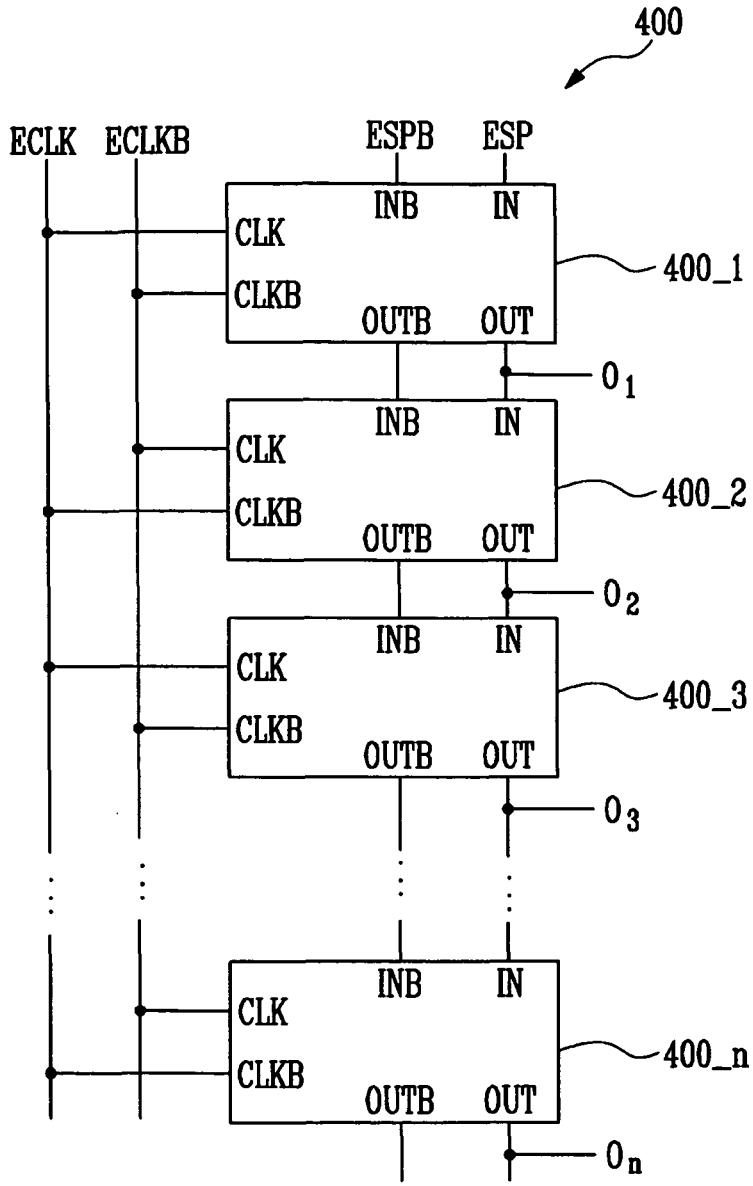
FIG. 2 illustrates a block diagram of an exemplary structure of an emission control driver employable by the organic light emitting display of FIG. 1.

FIG. 2 illustrates a block diagram of an exemplary embodiment of the emission control driver 400 employable by the organic light emitting display of FIG. 1.

Referring to FIG. 2, the emission control driver 400 may include a plurality of stages 400_1, 400_2, 400_3, and **400_*n*. The stages 400_1, 400_2, 400_3, and 400_*n* may receive signals through an input signal terminal IN, a inverted input signal terminal INB, a clock terminal CLK, and a inverted clock terminal CLKB, and may output signals through an output signal terminal OUT, and a inverted output signal OUTB. More particularly, the stages 400_1 to 400_*n* may sequentially generate the emission control signals based on signals received at the input terminal IN, the inverted input signal terminal INB, the clock terminal CLK, and/or the inverted clock terminal CLKB. For example, e.g., in the first state 400_1, a start pulse ESP and a inverted start pulse ESPB may be transmitted to the input signal terminal IN and the inverted input signal terminal INB, respectively. The second stage 400_2 through the n-th stage 400_*n*, may receive the output signal and the inverted output signal of a previous stage at the input signal terminal IN and the inverted input signal terminal INB, respectively, thereof. For example, for the third stage 400_3, an output signal at an output signal terminal OUT and a inverted output signal at a inverted output signal terminal OUTB of the second stage 400_2 may be transmitted to the input signal terminal IN and the inverted input signal terminal INB of the third stage 400_3**.

In some embodiments, each the respective emission control lines E1 to En of the display may be coupled to a respective output terminal O1, O2, O3, On of the corresponding stage 400_1 to **400_*n* of the emission control driver 400. However, embodiments are not limited thereto. For example, while n stages 400_1 to 400_*n* may be illustrated in the exemplary embodiment of the emission control driver 400 of FIG. 2, in some embodiments, an emission control driver may include, e.g., less than n stages and a plurality, e.g., two, of the emission control lines E1** to En of the display may be coupled to each respective output terminal O of such an emission control driver. More particularly, by reducing a number of stages of the emission control driver, a size of the emission control driver may be reduced.

Figure 3:
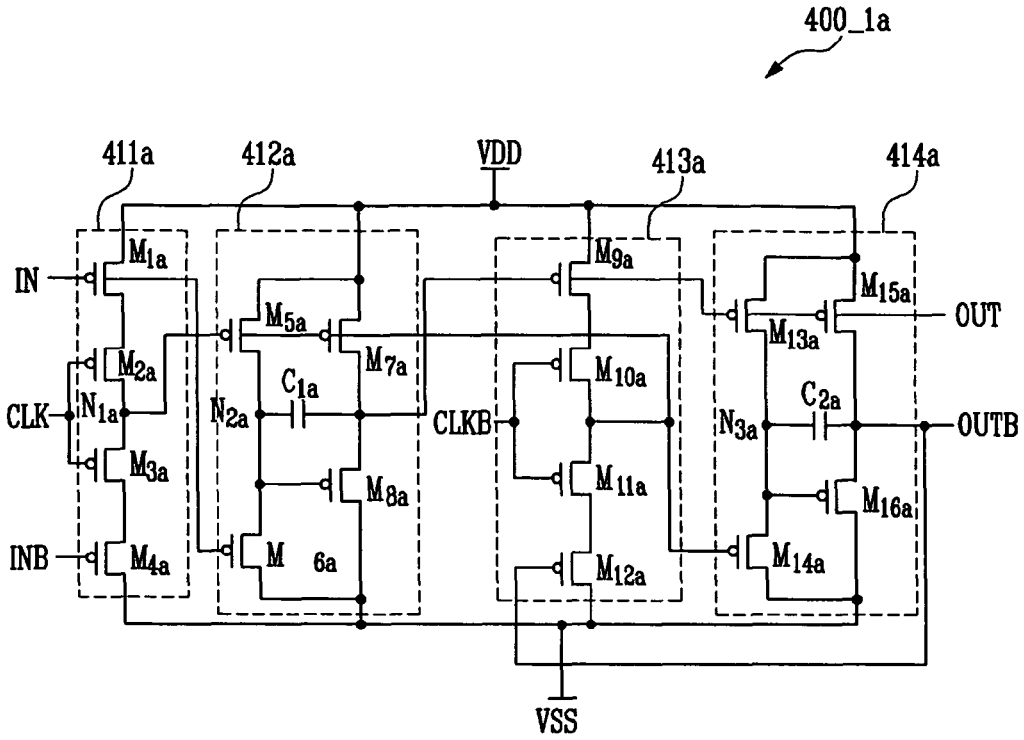
FIG. 3 illustrates a schematic diagram of a first exemplary embodiment of a stage of the emission control driver of FIG. 2.

FIG. 3 illustrates a schematic diagram of a first exemplary embodiment of a first stage **400_1*a* of the emission control driver of FIG. 2**.

Referring to FIG. 3, the first stage **400_1*a* may include a plurality of signal processing units, e.g., first, second, third and fourth signal processing units 411*a*, 412*a*, 413*a*, 414*a***.

The first signal processing unit **411*a* may include first, second, third, and fourth transistors M1*a*, M2*a*, M3*a*, and M4*a*. A source of the first transistor M1*a* may be coupled to a first power source VDD, a drain of the first transistor M1*a* may be coupled to a source of the second transistor M2*a*, and a gate of the first transistor Mia may be coupled to the input signal terminal IN. The source of the second transistor M2*a* may be coupled to the drain of the first transistor M1*a*, a drain of the second transistor M2*a* may be coupled to a first node N1*a*, and a gate of the second transistor M2*a* may be coupled to the clock terminal CLK. A source of the third transistor M3*a* may be coupled to the first node N1*a*, a drain of the third transistor M3*a* may be coupled to a source of the fourth transistor M4*a*, and a gate of the third transistor M3*a* may be coupled to the clock terminal CLK. The source of the fourth transistor M4*a* may be coupled to the drain of the third transistor M3*a*, a drain of the fourth transistor M4*a* may be coupled to a second power source VSS, and a gate of the fourth transistor M4*a*** may be coupled to the inverted input signal terminal INB.

The second signal processing unit **412*a* may include fifth, sixth, seventh, and eighth transistors M5*a*, M6*a*, M7*a*, M8*a* and a first capacitor C1*a*. A source of the fifth transistor M5*a* may coupled to the first power source VDD, a drain of the fifth transistor M5*a* may be coupled to a second node N2*a*, and a gate of the fifth transistor M5*a* may be coupled to the first node N1*a*. A source of the sixth transistor M6*a* may be coupled to the second node N2*a*, a drain of the sixth transistor M6*a* may be coupled to the second power source VSS, and a gate of the sixth transistor M6*a* may be coupled to the input signal terminal IN. A source of the seventh transistor M7*a* may be coupled to the first power source VDD, a drain of the seventh transistor M7*a* may be coupled to the output terminal OUT, and a gate of the seventh transistor M7*a* may be coupled to a first node N1. A source of the eighth transistor M8*a* may be coupled to the drain of the seventh transistor M7*a* and the output terminal OUT, a drain of the eighth transistor M8*a* may be coupled to the second power source VSS, and a gate of the eighth transistor M8*a* may be coupled to the second node N2*a*. A first electrode of the first capacitor C1*a* may be coupled to the second node N2 and a second electrode of the first capacitor C1*a*** may be coupled to the output terminal OUT.

The third signal processing unit **413*a* may include ninth, tenth, eleventh, and twelfth transistors M9*a*, M10*a*, M11*a*, M12*a*. A source of the ninth transistor M9*a* may be coupled to the first power source VDD, a drain of the ninth transistor M9*a* may be coupled to a source of the tenth transistor M10*a*, and a gate of the ninth transistor M9*a* may be coupled to the output terminal OUT. The source of the tenth transistor M10*a*** may be coupled to the drain of the ninth transistor M9*a*, a drain of the tenth transistor M10*a* may be coupled to the first node N1*a*, and a gate of the tenth transistor M10*a* may be coupled to the inverted clock terminal CLKB. A source of the eleventh transistor M11*a* may be coupled to the first node N1*a*, a drain of the eleventh transistor M11*a* may be coupled to a source of the twelfth transistor M12*a*, and a gate of the eleventh transistor M11*a* may be coupled to the inverted clock terminal CLKB. The source of the twelfth transistor M12*a* may be coupled to the drain of the eleventh transistor M11*a*, a drain of the twelfth transistor M12*a* may be coupled to the second power source VSS, and a gate of the twelfth transistor M12*a* may be coupled to the inverted output terminal OUTB.

The fourth signal processing unit 414*a* may include thirteenth, fourteenth, fifteenth, and sixteenth transistors M13*a*, M14*a*, M15*a*, M16*a* and a second capacitor C2*a*. A source of the thirteenth transistor M13*a* may be coupled to the first power source VDD, a drain of the thirteenth transistor M13*a* may be coupled to a third node N3*a*, and a gate of the thirteenth transistor M13*a* may be coupled to the output terminal OUT. A source of the fourteenth transistor M14*a* may be coupled to the third node N3*a*, a drain of the fourteenth transistor M14*a* may be coupled to the second power source VSS, and a gate of the fourteenth transistor M14*a* may be coupled to the first node Nla. A source of the fifteenth transistor M15*a* may be coupled to the first power source VDD, a drain of the fifteenth transistor M15*a* may be coupled to the inverted output terminal OUTB, and a gate of the fifteenth transistor M15*a* may be coupled to the output terminal OUT. A source of the sixteenth transistor M16*a* may be coupled to the inverted output terminal OUTB, a drain of the sixteenth transistor M16*a* may be coupled to the second power source VSS, and a gate of the sixteenth transistor M16*a* may be coupled to the third node N3*a*. A first electrode of the second capacitor C2*a* may be coupled to the third node N3*a* and a second electrode of the second capacitor C2*a* may be coupled to the inverted output terminal OUTB.

Figure 4A:
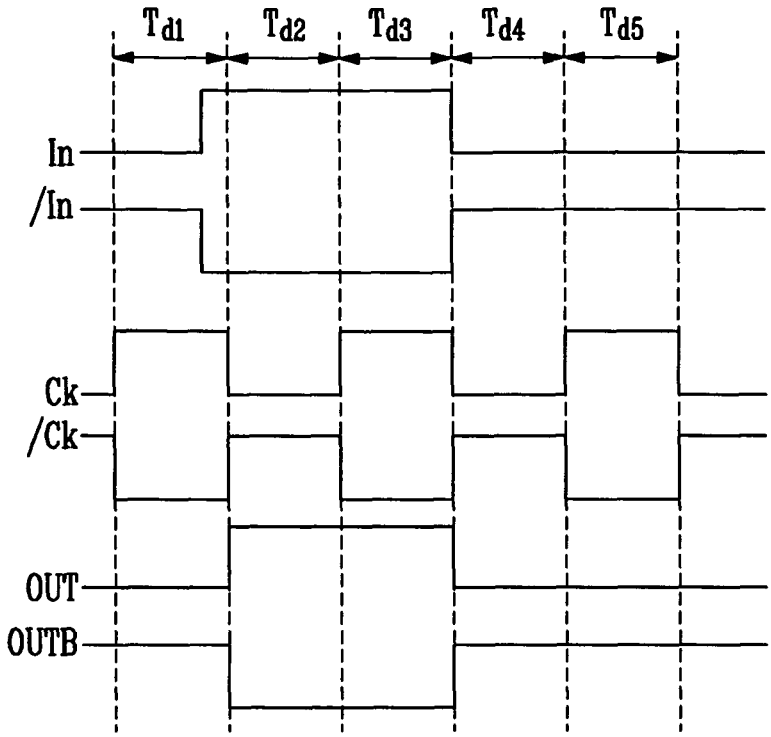
FIG. 4A illustrates an exemplary timing diagram of signals employable for operating the exemplary stage of FIG. 3.
Figure 4B:
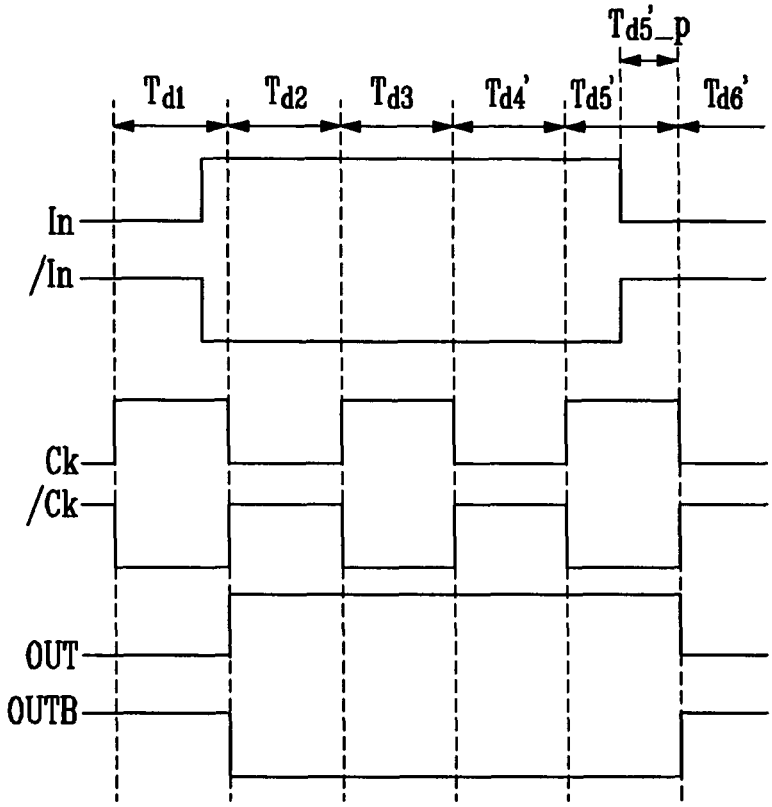
FIG. 4B illustrates another exemplary timing diagram of signals employable for operating the exemplary stage of FIG. 3.

FIGS. 4A and 4B illustrate exemplary timing diagrams of signals employable for operating the exemplary first stage 400_1*a* of FIG. 3. It should be understood that while the following description refers to the first stage 400_1*a* of FIG. 3, embodiments are not limited thereto, and the features described below may be applied to other stages. More particularly, in the exemplary timing diagram of FIG. 4A, a pulse width of input signals is smaller than a pulse width of input signals in the exemplary embodiment of FIG. 4B. The input signals may correspond to the emission start pulse ESP and the inverted emission start pulse ESPB for the first stage 400_1*a*, and, for the second through nth stages 400_2 to 400_*n*, may correspond to the respective output signals output from the output terminal OUT and the inverted output terminal OUTB of a previous stage. Also, as a result of a system setup and hold time requirements, an input signal In and a inverted input signal /In may rise or fall prior to a clock signal Ck and a inverted clock signal /Ck.

First, referring to FIG. 4A, the stage 400_1*a* may receive the input signal In, the inverted input signal /In, the clock signal Ck, and the inverted clock signal /Ck to operate. The stage 400_1*a* may receive the first power source VDD having a high level and the second power source VSS having a low level as driving voltages.

During a first period Td1, the input signal In and the inverted clock signal /Ck at low levels and the inverted input signal /In and the clock signal Ck are at high levels. Referring to FIGS. 3 and 4A, during the first period Td1, with the input signal In and the inverted clock signal /Ck at low levels, and the inverted input signal /In and the clock signal Ck at high levels, the first transistor M1*a* and the sixth transistor M6*a* are turned on by the input signal In, the fourth transistor M4*a* is turned off by the inverted input signal /In, and the second transistor M2*a* and the third transistor M3*a* are turned off by the clock signal Ck.

When the sixth transistor M6*a* is turned on, current flows from the second node N2*a* to the second power source VSS and the second node N2*a* may be at a low level and the eighth transistor M8*a* may be turned on. More particularly, as the first power source VDD has a high level, for the second node N2*a* to be at a low level, the fifth transistor M5*a* and the seventh transistor M7*a* may be turned off, i.e., the first node N1*a* may be at a high level, to prevent a supply of a high voltage of the first power source to the second node N2*a* and the output terminal OUT. With the first node N1*a* at the high level, the fourteenth transistor M14*a* may also be turned off. Therefore, in the exemplary embodiment of FIGS. 3 and 4A, under such conditions during the first period Td1, the second node N2*a* and the output terminal OUT are at low levels.

If the voltage of the second node N2*a* equals the voltage of the output terminal OUT, the eighth transistor M8*a* may be turned off and the voltage of the output terminal OUT may not be further reduced, e.g., may not be sufficiently reduced. Thus, the first capacitor C1*a* may be coupled between the second node N2*a* and the output terminal OUT such that the voltage of the second node N2*a* may be reduced as much as the voltage of the output terminal OUT is reduced, and the voltage of the second node N2*a* may be less than the voltage of the output terminal OUT. For example, the voltage of the output terminal OUT may be reduced to the voltage of the second power source VSS.

Referring still to FIGS. 3 and 4A, during the first period Td1, with the output terminal OUT at a low level, the ninth transistor M9*a*, the thirteenth transistor M13*a*, and the fifteenth transistor M15*a* are turned on. During the first period Td1, with the inverted clock signal /Ck at a low level, the tenth transistor M10*a* and the eleventh transistor M11*a* are turned on. Therefore, a voltage of the first power source VDD may be transmitted to the first node N1*a* through the ninth transistor M9*a* and the tenth transistor M10*a*, and the first node N1*a* is at a high level. Referring to FIG. 3, with the voltage of the first node N1*a* being transmitted to the gate of the fourteenth transistor M14*a*, the fourteenth transistor M14*a* is turned off. When the thirteenth transistor M13*a* and the fifteenth transistor M15*a* are turned on, the first power source VDD is transmitted to the third node N3*a* and the inverted output terminal OUTB so that the third node N3*a* and the inverted output terminal OUTB are at high levels. When the third node N3*a* at a high level, the sixteenth transistor M16*a* is turned off. Under such conditions, the inverted output terminal OUTB is at a high level. When the inverted output terminal OUTB is at a high level, the twelfth transistor M12*a* is turned off. By turning off the twelfth transistor M12*a*, the eleventh transistor M11*a* may be prevented from being coupled to the second power source VSS.

Referring to FIG. 4A, during a second period Td2, the inverted input signal /In and the clock signal Ck are at low levels and the input signal In and the inverted clock signal /Ck are at high levels. With the input signal In at a high level, the first transistor M1*a* and the sixth transistor M6*a* are turned off. With the inverted input signal /In and the clock signal Ck at low levels, the second, third and fourth transistors M2*a*, M3*a*, M4*a* are turned on.

When the second, third and fourth transistors M2*a*, M3*a*, M4*a* are turned on, current may flow from the first node N1*a* to the second power source VSS so that the first node N1 may be at a low level. When the first node N1*a* is at a low level, the fifth transistor M5*a* and seventh transistor M7*a* are turned on so that a voltage of the first power source VDD is transmitted to the second node N2*a* and the output terminal OUT. As discussed below, with the first node N1*a* at a low level, the fourteenth transistor M14*a* is also turned on. With the input signal In at the high level during the second period Td2, the sixth transistor M6*a* is turned off and current flow from the second node N2*a* to the second power source VSS is blocked. With the high level at the second node N2*a*, the eighth transistor M8*a* is also turned off.

When the output terminal OUT is at a high level, the ninth transistor M9*a*, the thirteenth transistor M13*a*, and the fifteenth transistor M15*a* are turned off. During the second period Td2, with the inverted clock signal /Ck at a high level, the tenth transistor M10*a* and the eleventh transistor M11*a* are turned off. Referring to FIG. 3, the twelfth transistor M12*a* is coupled to the inverted output terminal OUTB and, as discussed above, with the inverted output terminal OUTB at a high level during the first period Td1, the twelfth transistor M12*a* is turned off. With the first node N1 at a low level, the fourteenth transistor M14*a* is turned on. When the fourteenth transistor M14*a* is turned on, current flows from the third node N3*a* to the second power source VSS, and the sixteenth transistor M16*a* may also be turned on. Thus, during the second period Td2, a voltage of the second power source VSS is transmitted to the inverted output terminal OUTB, and the inverted output terminal OUTB is at a low level. More particularly, a voltage between the third node N3*a* and the inverted output terminal OUTB is maintained by the second capacitor C2*a* coupled between the third node N3*a* and the inverted output terminal OUTB so that the sixteenth transistor M16 is turned on during the second period.

Referring to FIG. 4A, during a third period Td3, the input signal In and the clock signal Ck are at high levels and the inverted input signal /In and the inverted clock signal /Ck are at low levels. With the input signal In at a high level, the first transistor Mia and the sixth transistor M6*a* are turned off. With the clock signal Ck at a high level, the first, second and third transistors M1*a*, M2*a*, M3*a* are turned off. With the inverted input signal /In at a low level, the fourth transistor M4*a* is turned on.

With the inverted clock signal /Ck at a low level, the tenth transistor M10*a* and the eleventh transistor M11*a* are turned on. During the third period Td3, with the inverted output terminal OUTB at a low level, the twelfth transistor M12*a* is turned on. More particularly, current may flow from the first node N1*a* coupled between the tenth transistor M10*a* and the eleventh transistor M11*a* to the second power source VSS through the twelfth transistor M12*a* so that the first node N1*a* is at a low level during the third period Td3.

When the first node N1*a* is at a low level, the fifth transistor M5*a* and the seventh transistor M7*a* are turned on. Thus, a voltage of the first power source VDD is transmitted to the second node N2*a* and the output terminal OUT, and the second node N2*a* and the output terminal OUT are at high levels. With the sixth transistor M6*a* turned off with the input signal In at a high level, current flow from the second node N2*a* to the second power source VSS is blocked and the second node N2*a* is at a high level. When the second node N2*a* is at a high level, the eighth transistor M8*a* is turned off so that the voltage of the output terminal OUT is at a high level.

With the output terminal OUT at a high level, the ninth transistor M9*a*, the thirteenth transistor M13*a*, and the fifteenth transistor M15*a* are turned off so that the first power source VDD is not transmitted to the inverted output terminal OUTB. Since the first node N1*a* is at a low level, the fourteenth transistor M14*a* is turned on. Therefore, the second power source VSS is transmitted to the third node N3*a* and the inverted output terminal OUTB and current may flow from the third node N3*a* to the second power source VSS through the fourteenth transistor M14*a*. Under such conditions, the third node N3*a* is at a low level. With the third node N3*a* at a low level, the sixteenth transistor M16*a* is turned on so that current may flow from the inverted output terminal OUTB to the second power source VSS. Under such conditions, the inverted output terminal OUTB is at a low level. The sixteenth transistor M16*a* may be turned off when the voltage of the inverted output terminal OUTB is equal to the voltage of the third node N3*a*, and the flow of current from the inverted output terminal OUTB to the second power source VSS may be blocked. As a result, the voltage of the inverted output terminal OUTB may not be sufficiently low. Thus, the second capacitor C2*a* may be coupled between the third node N3*a* and the inverted output terminal OUTB. The second capacitor C2*a* maintains a voltage between the inverted output terminal OUTB and the third node N3*a* so that, when the voltage of the inverted output terminal OUTB is reduced, a voltage at the third node N3 is further reduced. Under such conditions, a voltage across the gate and the source terminals of the sixteenth transistor M16 may be maintained such that the sixteenth transistor M16*a* is not turned off and a voltage at the inverted output terminal OUTB may be sufficiently reduced.

During a fourth period Td4, the input signal In and the clock signal Ck are at low levels and the inverted input signal /In and the inverted clock signal /Ck are at high levels. With the input signal In at a low level, the first and sixth transistors Mla, M6*a* are turned on. With the clock signal Ck at a low level, the second and third transistors M2*a*, M3*a* are turned on. With the inverted input signal /In at a high level, the fourth transistor M4 is turned off. When the first, second and third transistors M1*a*, M2*a*, M3*a* are turned on, a voltage of the first power source VDD is transmitted to the first node N1*a* so that the first node N1*a* is at a high level.

With the first node N1*a* at a high level, the fifth transistor M5*a* and the seventh transistor M7*a* are turned off. Therefore, a voltage of the first power source VDD is not transmitted to the second node N2*a* and the output terminal OUT. With the sixth transistor M6*a* turned on by the input signal In at a low level, current flows from the second node N2*a* to the second power source VSS so that the second node N2*a* is at a low level. With the second node N2*a* at a low level, the eighth transistor M8*a* is turned on so that current flows from the output terminal OUT to the second power source VSS and that the output terminal OUT is at a low level. The eighth transistor M8*a* may be maintained on by the first capacitor C1*a*.

With the output terminal OUT is at a low level, the ninth transistor M9*a*, the thirteenth transistor M13*a*, and the fifteenth transistor M15*a* are turned on. With the inverted clock signal /Ck at a high level, the tenth transistor M10*a* and the eleventh transistor M11*a* are turned off and the first node N1*a* at a high level. With the first node N1*a* at a high level, the fourteenth transistor M14*a* is turned off. In addition, the thirteenth transistor M13*a* and the fifteenth transistor M15*a* are turned on as the output terminal OUT is at a low level. With the thirteenth transistor M13*a* and the fifteenth transistor M15*a* turned on, the first power source VDD is transmitted to the third node N3*a* and the inverted output terminal OUTB. Therefore, the third node N3*a* and the inverted output terminal OUTB are at high levels. With the fourteenth transistor M14*a* turned off, and the third node N3*a* at a high level, the sixteenth transistor M16 is turned off and current flow from the third node N3 and the inverted output terminal OUTB to the second power source VSS is blocked so that the third node N3*a* and the inverted output terminal OUTB are at high levels.

During a fifth period Td5, the input signal In and the inverted clock signal /Ck are at low levels and the inverted input signal /In and the clock signal Ck are at high levels. With the input signal In at a low level, the first transistor M1*a* and the sixth transistor M6*a* are turned on. With the clock signal Ck at a high level, the second transistor M2*a* and the third transistor M3*a* are turned off. With the inverted input signal /In at a high level, the fourth transistor M4*a* is turned off. With the inverted clock signal /Ck at a low level, the tenth transistor M10*a* and the eleventh transistor M11*a* are turned on. As a result of the inverted output terminal OUTB being at a high level during the fourth period Td4, the twelfth transistor M12*a* is turned off. Thus, the first node N1*a* is floated. Therefore, the second node N2*a* and the output terminal OUT maintain their voltage from a previous period, e.g., the fourth period Td4. That is, the second node N2*a* and the output terminal OUT are at low levels. Since the second node N2*a* and the output terminal OUT maintain their voltage from the previous, e.g., the fourth period Td4, the inverted output terminal OUTB also maintains its voltage from the previous period, e.g., the fourth period Td4.

Referring now to FIG. 4B, another exemplary embodiment of exemplary signals that may be employed to operate the exemplary stage 400_1*a* of FIG. 3 will be described below. In the exemplary embodiment of FIG. 4B, the exemplary driving method includes the first period, Td1, the second period Td2, the third period Td3, a fourth period Td4', a fifth period Td5', and a sixth period Td6'. In general, only differences between the exemplary embodiment of FIG. 4A and the exemplary embodiment of FIG. 4B will be described below, e.g., a description of the first, second and third periods Td1, Td2, Td3, which correspond to the first, second and third periods Td1, Td2, Td3 illustrated in FIG. 4A will not be repeated again below.

Referring to FIG. 4B, according to the exemplary embodiment illustrated therein, during the fourth period Td4', the input signal In and the inverted clock signal /Ck are at high levels and the inverted input signal /In and the clock signal Ck are at low levels. With the input signal In at a high level, the first transistor M1*a* and the sixth transistor M6*a* are turned off. With the clock signal Ck and the inverted input signal /In at a low level, the second transistor M2*a*, the third transistor M3*a*, and the fourth transistor M4*a* are turned on. Therefore, current may flow from the first node N1*a* to the second power source VSS, and the first node N1*a* is at a low level. With the inverted clock signal /Ck at a high level, the tenth transistor M10*a* and the eleventh transistor M11*a* are turned off.

With the first node N1*a* at a low level during the fourth period Td4', the fifth transistor M5*a* and the seventh transistor M7*a* are turned on. Therefore, a voltage of the first power source VDD is transmitted to the second node N2*a* and the output terminal OUT. With the input signal In is at the high level during the second period Td2, the sixth transistor M6*a* is turned off and current flow from the second node N2*a* to the second power source VSS is blocked. With the high level at the second node N2*a*, the eighth transistor M8*a* is also turned off. Therefore, the output terminal OUT is in a high level.

When the output terminal OUT is at a high level, the ninth transistor M9*a*, the thirteenth transistor M13*a*, and the fifteenth transistor M15*a* are turned off. During the second period Td2, with the inverted clock signal /Ck at a high level, the tenth transistor M10*a* and the eleventh transistor M11*a* are turned off. Therefore, the first node N1*a* is in a low level. Referring to FIG. 3, the twelfth transistor M12*a* is coupled to the inverted output terminal OUTB and, as discussed above, with the inverted output terminal OUTB at a low level during the third period Td3, the twelfth transistor M12*a* is turned on. As discussed above, with the first node N1 at a low level during the fourth period Td4', the fourteenth transistor M14*a* is turned on. When the fourteenth transistor M14*a* is turned on, current flows from the third node N3*a* to the second power source VSS, and the sixteenth transistor M16*a* may also be turned on. Thus, during the fourth period Td4', a voltage of the second power source VSS is transmitted to the inverted output terminal OUTB, and the inverted output terminal OUTB is at a low level. More particularly, a voltage between the third node N3*a* and the inverted output terminal OUTB is maintained by the second capacitor C2*a* coupled between the third node N3*a* and the inverted output terminal OUTB so that the sixteenth transistor M16 is turned on during the fourth period Td4'.

During the fifth period Td5', the input signal In and the clock signal Ck are at high levels and the inverted input signal /In and the inverted clock signal /Ck are at low levels. With the input signal In and the clock signal Ck are at high levels, the first, second, third and sixth transistors M1*a*, M2*a*, M3*a*, M6*a* are turned off. With the inverted input signal /In is at a low level, the fourth transistor M4*a* is turned on.

With the inverted clock signal /Ck at a low level, the tenth transistor M10*a* and the eleventh transistor M11*a* are turned on. With the inverted output terminal OUTB at a low level during the fourth period Td4', the twelfth transistor M12*a* is turned on. Therefore, current may flow from the first node N1*a* coupled between the tenth transistor M10*a* and the eleventh transistor M11*a* to the second power source VSS through the twelfth transistor M12*a* so that the first node N1*a* is at a low level.

When the first node N1*a* is at a low level, the fifth transistor M5*a* and the seventh transistor M7*a* are turned on. Therefore, a voltage of the first power source VDD is transmitted to the second node N2*a* and the output terminal OUT so that the second node N2*a* and the output terminal OUT are at high levels. At this time, since the sixth transistor M6*a* is turned off as a result of a high level of the input signal In, current flow from the second node N2*a* to the second power source VSS is blocked and the second node N2*a* is at a high level. When the second node N2*a* is at a high level, the eighth transistor M8*a* is turned off and a voltage of the output terminal OUT is at a high level.

With the output terminal OUT at a high level, the ninth transistor M9*a*, the thirteenth transistor M13*a*, and the fifteenth transistor M15*a* are turned off so that the first power source VDD is not transmitted to the inverted output terminal OUTB. With the first node N1*a* at a low level during the fifth period Td5', the fourteenth transistor M14*a* is turned on. Therefore, a voltage of the second power source VSS is transmitted to the third node N3*a* and the inverted output terminal OUTB so that current flows from the third node N3*a* to the second power source VSS through the fourteenth transistor M14*a* and that the third node N3*a* is at a low level. With the third node N3*a* at a low level, the sixteenth transistor M16*a* is turned on so that current flows from the inverted output terminal OUTB to the second power source VSS. Therefore, the inverted output terminal OUTB is at a low level during the fifth period Td5'. The sixteenth transistor M16*a* may be turned off when the voltage of the inverted output terminal OUTB is equal to the voltage of the third node N3*a*, and the flow of current from the inverted output terminal OUTB to the second power source VSS may be blocked. As a result, the voltage of the inverted output terminal OUTB may not be sufficiently low. Thus, the second capacitor C2*a* may be coupled between the third node N3*a* and the inverted output terminal OUTB. The second capacitor C2*a* maintains a voltage between the inverted output terminal OUTB and the third node N3*a* so that, when the voltage of the inverted output terminal OUTB is reduced, a voltage at the third node N3 is further reduced. Under such conditions, a voltage across the gate and the source terminals of the sixteenth transistor M16 may be maintained such that the sixteenth transistor M16*a* is not turned off and a voltage at the inverted output terminal OUTB may be sufficiently reduced.

During the sixth period Td6', the input signal In and the clock signal Ck are at low levels and the inverted input signal /In and the inverted clock signal /Ck are at high levels. With the input signal In at a low level, the first transistor M1*a* and the sixth transistor M6*a* are turned on. With the clock signal Ck at a low level, the second transistor M2*a* and the third transistor M3*a* are turned on. With the inverted clock signal /Ck at a high level, the tenth transistor M10*a* and the eleventh transistor M11*a* are turned off. With the first, second and third transistors M1*a*, M2*a*, M3*a* turned on, the first node N1*a* is at a high level. Thus, the fifth, seventh, and fourteenth transistors M5*a*, M7*a*, M14*a* are turned off. With the sixth transistor M6*a* turned on, the second node N2*a* and the output terminal OUT are at a low level and the eighth transistor M8*a* is turned on. With the output terminal out at a low level, a voltage of the first power source VDD at a high level is supplied to the third node N3*a* and to the second terminal of the capacitor C2*a* via the thirteenth and fifteenth transistors M13*a*, M15*a*, respectively. Thus, the inverted output terminal OUTB is at a high level.

In embodiments, as a result of signal characteristics, timing delays, setup and hold times, etc., it is understood that other combinations of, e.g., the input signal In, the inverted input signal /In, the clock signal Ck, the inverted clock signal /Ck, the output signal at the output terminal OUT, and the inverted output signal at the inverted output terminal OUTB may result. More particularly, referring to FIG. 4B, e.g., during a portion Td5'_p of the fifth period Td5', the input signal In and the inverted clock signal /Ck are at low levels, and the inverted input signal /In and the clock signal Ck are at high levels. With the input signal In at a low level, the first and sixth transistor Mla, M6*a* are turned on. With the clock signal Ck at a high level, the second and third transistors M2*a*, M3*a* are turned off. With the inverted clock signal /Ck at low level, the tenths and eleventh transistors M10*a*, M11*a* are turned on.

With the inverted output terminal OUTB being at a low level before the portion Td5'_p, the twelfth transistor M12*a* may be turned on. With the tenth, eleventh and twelfth transistors M10*a*, M11*a*, M12*a* turned on, the first node N1*a* is at a low level. With the first node N1*a* at a low level, the fifth and seventh transistors M5*a*, M7*a* are turned on. With the fifth and seventh transistors M5*a*, M7*a* turned on, a high level voltage of the first power source VDD may be supplied to the second terminal of the capacitor C1*a*. More particularly, under such conditions, the fifth, sixth and seventh transistors M5*a*, M6*a*, M7*a* are turned on, and a path may exist between the first power source VDD and the second power source VSS. That is, when the fifth transistor M5*a* and the sixth transistor M6*a* are simultaneously turned on, the first power source VDD and the second power source VSS are coupled and current may flow.

To reduce and/or eliminate an effect of such an occurrence, although the fifth transistor M5*a* and the sixth transistor M6*a* may be simultaneously turned on, the fifth and sixth transistors M5*a*, M6*a* may be set such that a width/length ratio of the fifth transistor M5*a* is larger than a width/length ratio of the sixth transistor M6*a*. Accordingly, even if the fifth transistor M5*a* and the sixth transistor M6*a* are simultaneously turned on, the second node N2*a* may be at a high level. With the second node N2*a* at a high level, the eighth transistor M8*a* is turned off, and the output terminal OUT is at a high level.

Further, under such conditions, with the output terminal OUT at a high level, the thirteenth transistor M13*a* and the fifteenth transistor M15*a* are turned off. With the first node N1*a* at a low level, the fourteenth transistor M14*a* is turned on. Therefore, current flows from the third node N3*a* to the second power source VSS through the fourteenth transistor M14*a* and the third node N3*a* is at a low level. With the third node N3*a* at a low level, the sixteenth transistor M16*a* is turned on so that current flows from the inverted output terminal OUTB to the second power source VSS through the sixteenth transistor M16*a* and that the inverted output terminal OUTB is at a low level.

Referring to FIGS. 4A and 4B, embodiments may enable the input signal In and the output signal at the output terminal OUT to have the same and/or substantially same waveform. More particularly, e.g., in embodiments, a pulse width of an output signal supplied to an output terminal may be obtained by multiplying a number of times when a pulse width of a corresponding input signal reaches a falling edge of a clock signal by a period of the clock signal. Thus, embodiments of an emission control driver employing one or more features described above may supply output signals including a same number of pulses as a number of pulses of a corresponding input signal. Embodiments may enable a pulse width of an output signal to be controlled based on a pulse width and a number of pulses of a corresponding input signal.

More particularly, e.g., in the exemplary embodiment of FIG. 4A, the illustrated input signal In and the corresponding output signal at the output terminal OUT correspond to a single period of the illustrated clock signal Ck. In the exemplary embodiment of FIG. 4B, the illustrated input signal In and the corresponding output signal at the output terminal OUT correspond to two periods of the illustrated clock signal Ck.

Figure 5:
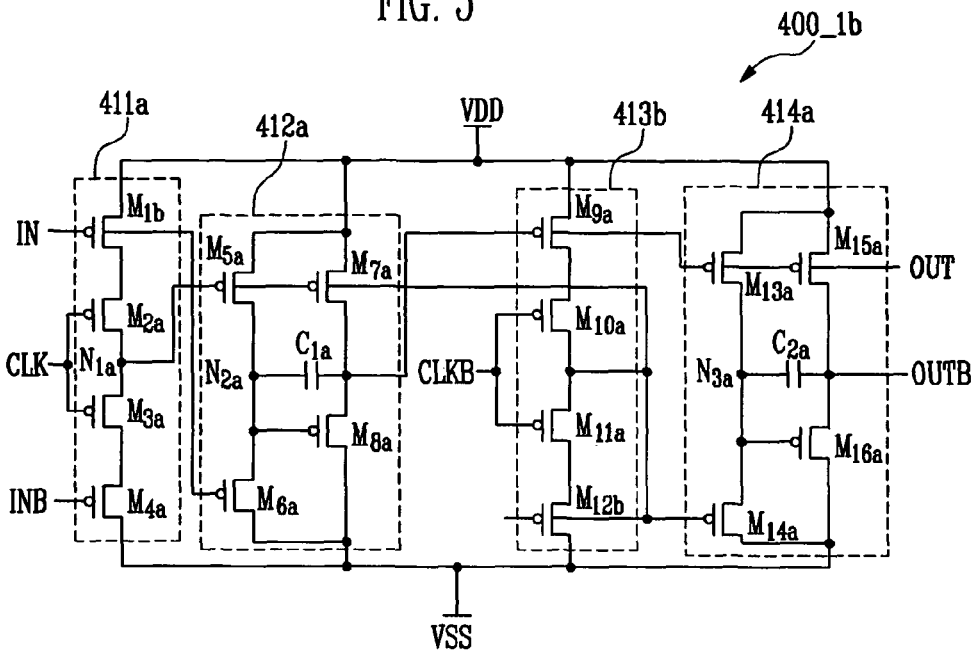
FIG. 5 illustrates a schematic diagram of a second exemplary embodiment of a stage of the emission control driver of FIG. 2.

FIG. 5 illustrates a schematic diagram of a second exemplary embodiment of a first stage 400_1*b* employable by the emission control driver 400 of FIG. 2. In general, only differences between the exemplary stage 400_1*b* of FIG. 5 and the exemplary stage 400_1*a* of FIG. 3 will be described below.

Referring to FIG. 5, the stage 400_1*b* may include the first signal processing unit 411*a*, the second signal processing unit 412*a*, a third signal processing unit 413*b*, and the fourth signal processing unit 414*a*.

More particularly, the third signal processing unit 413*b* may substantially correspond to the third signal processing unit 413*a*, except with regard to a twelfth transistor M12*b* thereof. That is, the third signal processing unit 413*b* may include the ninth, tenth and eleventh transistors M9*a*, M10*a*, M11*a*, as described above with regard to FIG. 3, as well as the twelfth transistor M12*b* instead of the twelfth transistor M12*a*. More particularly, a source of the twelfth transistor M12*b* may be coupled to drain of the eleventh transistor M11*a*, a drain of the twelfth transistor M12*b* may be coupled to the second power source VSS, and a gate of the twelfth transistor M12*b* may be coupled to the first node N1*a*.

In the stage 400_1*b* having the structure illustrated in FIG. 5, the voltage of the first node N1*a* is equal to the voltage of the inverted output terminal OUTB. That is, e.g., when the first node N1*a* is at a low level, the inverted output terminal OUTB is at a low level. When the first node N1*a* is at a high level, the inverted output terminal OUTB is at a high level. Therefore, in operation, the exemplary stage 400_1*a* of FIG. 3 and the exemplary stage 400_1*b* of FIG. 5 may be equivalent. More particularly, while the gate of the twelfth transistor M12*a* of FIG. 3 is coupled to the inverted output terminal OUTB and the gate of the twelfth transistor M12*b* of FIG. 5 is coupled to the first node N1*a*, because the voltage of the inverted output terminal OUTB is equal to the voltage of the first node N1*a*, operations of the twelfth transistors M12*a*, M12*b* may be equivalent. That is, e.g., the above description of FIGS. 4A and 4B may also be applied to the exemplary stage 400_1*b* of FIG. 5.

Figure 6:
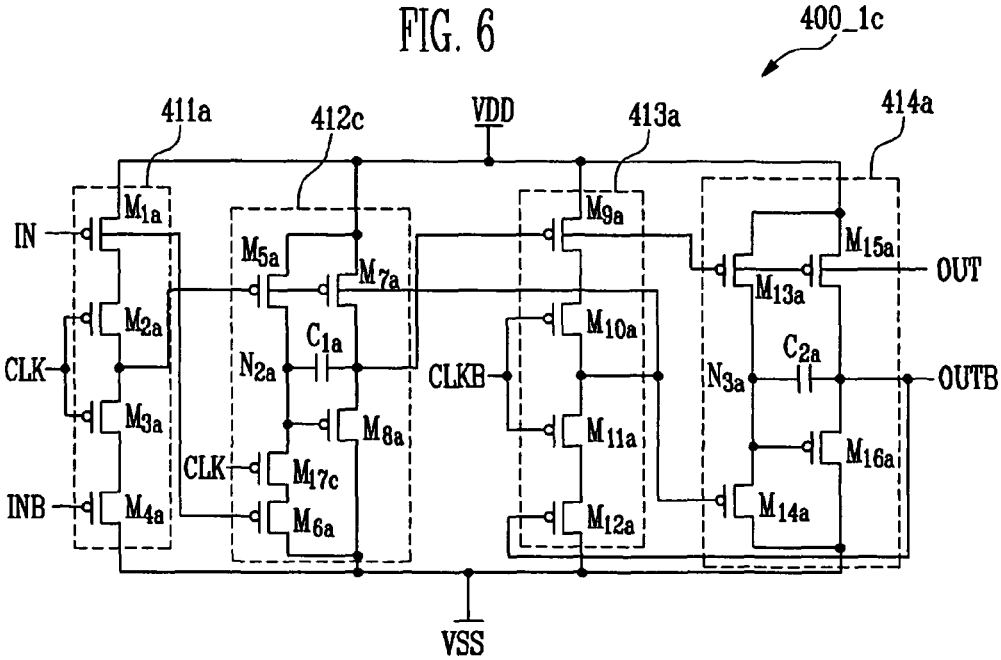
FIG. 6 illustrates a schematic diagram of a third exemplary embodiment of a stage of the emission control driver of FIG. 2.

FIG. 6 illustrates a schematic diagram of a third exemplary embodiment of a first stage 400_1*c* employable by the emission control driver 400 of FIG. 2. In general, only differences between the exemplary stage 400_1*c* of FIG. 6 and the exemplary stage 400_1*a* of FIG. 3 will be described below.

Referring to FIG. 6, the stage 400_1*c* may include the first signal processing unit 411*a*, a second signal processing unit 412*c*, the third signal processing unit 413*a*, and the fourth signal processing unit 414*a*.

The second signal processing unit 412*c* may include the fifth transistor M5*a*, the sixth transistor M6*a*, the seventh transistor M7*a*, the eighth transistor M8*a*, the first capacitor C1*a*, and a seventh transistor M17*c*. That is, relative to the exemplary stage 400_1*a* of FIG. 3, the exemplary stage 400_1*c* of FIG. 5 includes an additional transistor, e.g., M17*c*. Referring to FIG. 6, the gate of the eighth transistor M8*a* and the source of the sixth transistor M6*a* may be coupled via the seventeenth transistor M17*c*. More particularly, the seventeenth transistor M17*c* may be coupled between the gate of the eighth transistor M8*a* and the source of the sixth transistor M6*a*. That is, a gate of the seventeenth transistor may be coupled to the clock terminal CLK, a source of the seventeenth transistor may be coupled to the gate of the eighth transistor M8*a* and the second node N2*a*, and a drain of the seventeenth transistor M17*c* may be coupled to the source of the sixth transistor M6*a*.

As discussed above, during, e.g., the portion Td5'_p of the fifth period Td5' of FIG. 4B, the fifth transistor M5*a* and the sixth transistor M6*a* may be simultaneously turned on. Referring to FIGS. 4B and 6, by providing the seventeenth transistor M17*a* as in the exemplary stage 400_1*c*, the seventeenth transistor M17*a* receiving the clock signal Ck at a high level is turned off during the portion Td5'_p of the fifth period Td5'. Therefore, by providing the seventeenth transistor M17*a*, when the fifth transistor M5*a*, the seventh transistor M7*a* and the sixth transistor M6*a* are turned on, current cannot flow from the second node N2*a* to the second power source VSS, and the voltages of the second node N2*a* and the output terminal OUT are at high levels. Therefore, the stage 400_1*c* is not affected by a ratio of the length to width of the channels of the fifth transistor M5*c* and the sixth transistor M6*c*.

Figure 7:
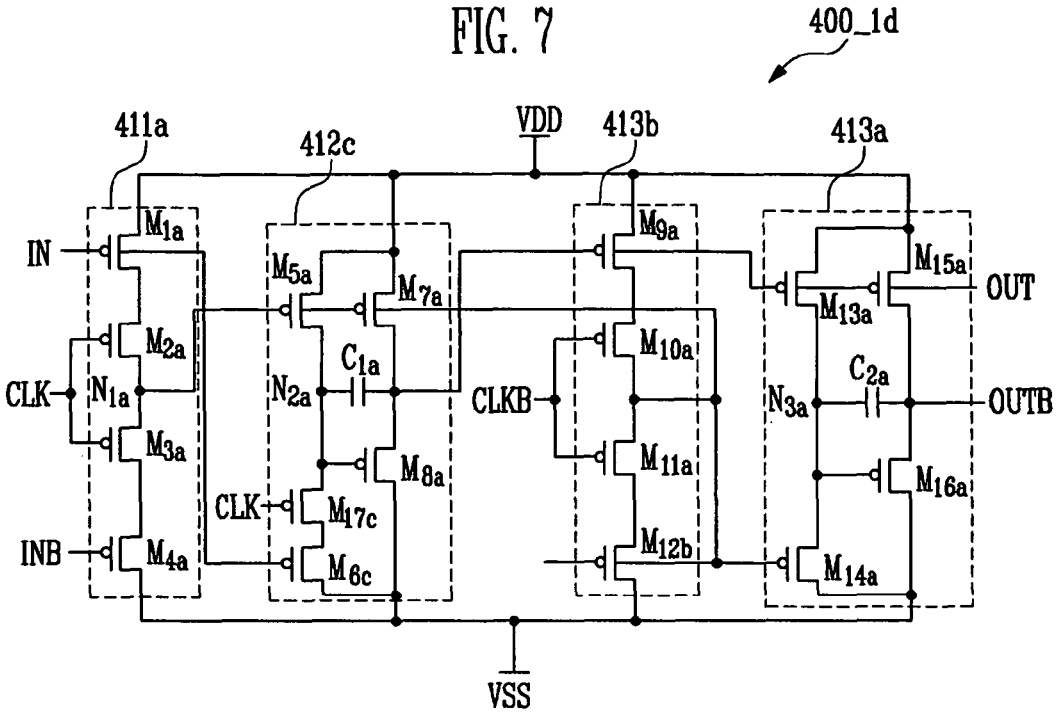
FIG. 7 illustrates a schematic diagram of a fourth exemplary embodiment of a stage of the emission control driver of FIG. 2.

FIG. 7 illustrates a schematic diagram of a fourth exemplary embodiment of a first stage of the emission control driver 400_1*d* employable by the emission control driver 400 of FIG. 2. In general, only differences between the exemplary stage 400_1*d* of FIG. 7 and the exemplary stages 400_1*a*, 400_1*b*, and 400_1*c* of FIGS. 3, 5 and 6 will be described below.

Referring to FIG. 7, the stage 400_1*d* may include the first signal processing unit 411*a* of FIG. 3, the second signal processing unit 412*c* of FIG. 5, the third signal processing unit 413*b* of FIG. 6, and the fourth signal processing unit 414*a* of FIG. 3. A description of each of the exemplary signal processing units 411*a*, 112*c*, 413*b* and 414*a* is set forth above, and will not be repeated.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof. For example, while all of the transistors illustrated in the accompanying Figures are illustrated as p-type transistors, persons of ordinary skill in the art appreciate that other transistors may be employed, e.g., n-type, a combination of p-type and n-type.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An emission control driver including a plurality of stages adapted to receive voltages from a first power source and a second power source and to generate emission control signals, wherein each of the stages comprises:

a first signal processing unit to generate a first output signal based on an input signal, a clock signal, a inverted input signal, the first power source, and the second power source, the first output signal being supplied at a first node of the first signal processing unit;

a second signal processing unit to output an emission control signal based on the first output signal and the input signal, the emission control signal corresponding to an inverse of the first output signal;

a third signal processing unit to transmit a voltage of the first power source or the second power source to the first signal processing unit based on the emission control signal, a inverted clock signal, and an inverted emission control signal when a first path, between the first power source and the first node, and a second path, between the second power source and the first node, are blocked by the clock signal, the inverted emission control signal corresponding to an inverse of the emission control signal; and a fourth signal processing unit to output the inverted emission control signal based on the emission control signal and the first output signal, wherein the second signal processing unit is coupled between the first signal processing unit and the third signal processing unit.

2. The emission control driver as claimed in claim 1, wherein the first signal processing unit includes first, second, third, and fourth transistors, wherein a source of the first transistor is coupled to the first power source, a drain of the first transistor is coupled to a source of the second transistor, and a gate of the first transistor is coupled to an input signal terminal to which the input signal is input, wherein a drain of the second transistor is coupled to the first node, and a gate of the second transistor is coupled to a clock terminal to which the clock signal is input, wherein a source of the third transistor is coupled to the first node, a drain of the third transistor is coupled to a source of the fourth transistor, and a gate of the third transistor is coupled to the clock terminal, and wherein a drain of the fourth transistor is coupled to the second power source, and a gate of the fourth transistor is coupled to a inverted input signal terminal to which the inverted input signal is input.

3. The emission control driver as claimed in claim 1, wherein the second signal processing unit includes fifth, sixth, seventh, and eighth transistors and a first capacitor, wherein a source of the fifth transistor is coupled to the first power source, a drain of the fifth transistor is coupled to a second node, and a gate of the fifth transistor is coupled to the first node, wherein a source of the sixth transistor is coupled to the second node, a drain of the sixth transistor is coupled to the second power source, and a gate of the sixth transistor is coupled to an input signal terminal to which the input signal is transmitted, wherein a source of the seventh transistor is coupled to the first power source, a drain of the seventh transistor is coupled to an output terminal from which the emission control signal is output by inverting the first output signal, and a gate of the seventh transistor is coupled to the first node, a source of the eighth transistor is coupled to the output terminal, a drain of the eighth transistor is coupled to the second power source, and a gate of the eighth transistor is coupled to the second node, and wherein a first electrode of the first capacitor is coupled to the second node and a second electrode of the first capacitor is coupled to the output terminal.

4. The emission control driver as claimed in claim 3, wherein the second signal processing unit further comprises a seventeenth transistor, wherein a source of the seventeenth transistor is coupled to the second node, a drain of the seventeenth transistor is coupled to the source of the sixth transistor, and a gate of the seventeenth transistor is coupled to the clock terminal.

5. The emission control driver as claimed in claim 4, wherein the third signal processing unit includes ninth, tenth, eleventh, and twelfth transistors, wherein a source of the ninth transistor is coupled to the first power source, a drain of the ninth transistor is coupled to a source of the tenth transistor, and a gate of the ninth transistor is coupled to an output terminal from which the emission control signal is output, wherein a drain of the tenth transistor is coupled to a source of the eleventh transistor, and a gate of the tenth transistor is coupled to a inverted clock terminal from which the inverted clock signal is output, wherein a drain of the eleventh transistor is coupled to a source of the twelfth transistor, and a gate of the eleventh transistor is coupled to the inverted clock terminal, and wherein a drain of the twelfth transistor is coupled to the second power source, and a gate of the twelfth transistor is adapted to receive the first output signal.

6. The emission control driver as claimed in claim 4, wherein the third signal processing unit includes ninth, tenth, eleventh, and twelfth transistors, wherein a source of the ninth transistor is coupled to the first power source, a drain of the ninth transistor is coupled to a source of the tenth transistor, and a gate of the ninth transistor is coupled to an output terminal from which the emission control signal is output, wherein a drain of the tenth transistor is coupled to a source of the eleventh transistor, and a gate of the tenth transistor is coupled to a inverted clock terminal from which the inverted clock signal is output, wherein a drain of the eleventh transistor is coupled to a source of the twelfth transistor, and a gate of the eleventh transistor is coupled to the inverted clock terminal, and wherein a drain of the twelfth transistor is coupled to the second power source, and a gate of the twelfth transistor is adapted to receive the inverted emission control signal.

7. The emission control driver as claimed in claim 3, wherein a ratio of width/length of a channel region of the fifth transistor is larger than a ratio of width/length of a channel region of the sixth transistor.

8. The emission control driver as claimed in claim 1, wherein the third signal processing unit includes ninth, tenth, eleventh, and twelfth transistors, wherein a source of the ninth transistor is coupled to the first power source, a drain of the ninth transistor is coupled to a source of the tenth transistor, and a gate of the ninth transistor is coupled to an output terminal from which the emission control signal is output, wherein a drain of the tenth transistor is coupled to a source of the eleventh transistor, and a gate of the tenth transistor is coupled to a inverted clock terminal from which the inverted clock signal is output, wherein a drain of the eleventh transistor is coupled to a source of the twelfth transistor, and a gate of the eleventh transistor is coupled to the inverted clock terminal, and wherein a drain of the twelfth transistor is coupled to the second power source, and a gate of the twelfth transistor is adapted to receive the inverted emission control signal.

9. The emission control driver as claimed in claim 1, wherein the third signal processing unit includes ninth, tenth, eleventh, and twelfth transistors, wherein a source of the ninth transistor is coupled to the first power source, a drain of the ninth transistor is coupled to a source of the tenth transistor, and a gate of the ninth transistor is coupled to an output terminal from which the emission control signal is output, wherein a drain of the tenth transistor is coupled to a source of the eleventh transistor, and a gate of the tenth transistor is coupled to a inverted clock terminal from which the inverted clock signal is output, wherein a drain of the eleventh transistor is coupled to a source of the twelfth transistor, and a gate of the eleventh transistor is coupled to the inverted clock terminal, and wherein a drain of the twelfth transistor is coupled to the second power source, and a gate of the twelfth transistor is adapted to receive the first output signal.

10. The emission control driver as claimed in claim 1, wherein the fourth signal processing unit includes thirteenth, fourteenth, fifteenth, and sixteenth transistors, and a second capacitor, wherein a source of the thirteenth transistor is coupled to the first power source, a drain of the thirteenth transistor is coupled to a third node, and a gate of the thirteenth transistor is coupled to an output terminal from which the emission control signal is output, wherein a source of the fourteenth transistor is coupled to the third node, a drain of the fourteenth transistor is coupled to the second power source, and a gate of the fourteenth transistor is adapted to receive the first output signal, wherein a source of the fifteenth transistor is coupled to the first power source, a drain of the fifteenth transistor is coupled to a inverted output terminal from which the inverted emission control signal is output, and a gate of the fifteenth transistor is coupled to the output terminal, wherein a source of the sixteenth transistor is coupled to the inverted output terminal, a drain of the sixteenth transistor is coupled to the second power source, and a gate of the sixteenth transistor is coupled to the third node, and wherein the second capacitor is coupled between the third node and the inverted output terminal.

11. The emission control driver as claimed in claim 1, wherein the plurality of stages include n stages, and for each of the second through n-th stages, the emission control signal output by the n-1 th stage is input as the input signal for the respective stage, and the inverted emission control signal output by the n-1 th stage is input as the inverted input signal for the respective stage.

12. The emission control driver as claimed in claim 1, wherein a pulse width of the emission control signal corresponds to a same number of clock cycles as a pulse width of the input signal.

13. An organic light emitting display, comprising:

a pixel unit including a plurality of pixels arranged in a region defined by scan lines, emission control lines, and data lines;

a scan driver adapted to transmit scan signals to the scan lines;

an emission control driver to transmit emission control signals to the emission control lines;

a data driver to transmit data signals to the data lines; and a controller to generate control signals for controlling the scan driver, the emission control driver, and the data driver, wherein each of the stages, includes:

a first signal processing unit to generate a first output signal based on an input signal, a clock signal, a inverted input signal, the first power source, and the second power source, the first output signal being supplied at a first node of the first signal processing unit;

a second signal processing unit to output the corresponding emission control signal based on the first output signal and the input signal, the emission control signal corresponding to an inverse of the first output signal;

a third signal processing unit to selectively transmit the first power source or the second power source to the first signal processing unit based on the emission control signal, a inverted clock signal, and an inverted emission control signal when a first path, between the first power source and the first node, and a second path, between the second power source and the first node, are blocked by the clock signal, the inverted emission control signal corresponding to an inverse of the emission control signal; and a fourth signal processing unit to output a inverted emission control signal based on the corresponding emission control signal and the first output signal, wherein the second signal processing unit is coupled between the first signal processing unit and the third signal processing unit.

14. The organic light emitting display as claimed in claim 13, wherein each of the emission control signals is transmitted to two of the emission control lines.

15. The organic light emitting display as claimed in claim 13, wherein each of the emission control signals is transmitted to one of the emission control lines.

16. The organic light emitting display as claimed in claim 13, wherein the controller is adapted generate the input signal, the inverted input signal, the clock signal, and the inverted clock signal to control pulse widths of the input signal and the inverted input signal.

17. The organic light emitting display as claimed in claim 13, wherein the pulse width of the input signal corresponds to a same number of clock periods as a pulse width of the corresponding emission control signal.

18. An emission control driver including a plurality of stages receiving a first power source and a second power source and driving the first power source and the second power source to generate emission control signals, wherein each of the stages comprises:

a first signal processing unit to generate a first output signal based on an input signal, a clock signal, a inverted input signal, the first power source, and the second power source, the first output signal being supplied at a first node of the first signal processing unit;

a second signal processing unit to output an emission control signal based on the first output signal and the input signal, the emission control signal corresponding to an inverse of the first output signal;

a third signal processing unit to selectively control a voltage at the first node of the first signal processing unit to correspond to a voltage transmitted from the first power source or the second power source, the third signal processing unit selectively controlling the voltage at the first node based on the emission control signal, a inverted clock signal, and an inverted emission control signal, the inverted emission control signal corresponding to an inverse of the emission control signal; and a fourth signal processing unit to output a inverted emission control signal based on the emission control signal and the first output signal, wherein the second signal processing unit is coupled between the first signal processing unit and the third signal processing unit.

19. The emission control driver as claimed in claim 18, wherein the first signal processing unit includes a plurality of transistors adapted to transmit the a voltage of the first power source or a voltage of the second power source to the first node based on the input signal, the clock signal and the inverted input signal, and the third signal processing unit is adapted to selectively control the voltage at the first node when the input signal, the inverted input signal and/or the clock signal prevent the transmission of the voltage of the first power source of the voltage of the second power source to the first node.

20. The emission control driver as claimed in claim 18, wherein the first output signal corresponds to the inverted emission control signal, and the inverted emission control signal is an inverse of the emission control signal.

21. The emission control driver as claimed in claim 1, further comprising:

a second node coupled to the second signal processing unit;

a first signal path coupled between the second node and the first power source;

a first transistor coupled along the first signal path;

a second signal path coupled between the second node and the second power source, and a second transistor coupled along the second signal path, wherein the first transistor has a first channel width/length ratio and the second transistor has a second channel width/length ratio, wherein the first channel width/length ratio allows a first amount of current to pass to the second node from the first power source and the second channel width/length ratio allows a second amount of current to pass to the second node from the second power source when the first and second transistors are simultaneously on, wherein the second amount of current is less than the first amount of current, and wherein the second node is coupled to output the emission control signal.

22. The emission control driver as claimed in claim 21, wherein:

the emission control signal has a value which lies in a predetermined range based on a difference between the first amount of current and the second amount of current when the first and second transistors are simultaneously on, and the predetermined range excludes a smallest magnitude of the emission control signal.

23. The emission control driver as claimed in claim 22, wherein the predetermined range includes a maximum magnitude of the emission control signal.

* * * * *